US009372057B2

(12) United States Patent
Diller

(10) Patent No.: US 9,372,057 B2
(45) Date of Patent: Jun. 21, 2016

(54) SHOTGUN SHELL TRACER AND TRACER MANUFACTURING DEVICE

(71) Applicant: Wendell Diller, Oakdale, MN (US)

(72) Inventor: Wendell Diller, Oakdale, MN (US)

( * ) Notice: Subject to any disclaimer, the term of this patent is extended or adjusted under 35 U.S.C. 154(b) by 0 days.

(21) Appl. No.: 14/199,122

(22) Filed: Mar. 6, 2014

(65) Prior Publication Data

US 2014/0261043 A1 Sep. 18, 2014

Related U.S. Application Data

(60) Provisional application No. 61/777,485, filed on Mar. 12, 2013.

(51) Int. Cl.
*F42B 12/38* (2006.01)
*F42B 7/08* (2006.01)
*F42B 33/02* (2006.01)

(52) U.S. Cl.
CPC ..... *F42B 12/387* (2013.01); *F42B 7/08* (2013.01); *F42B 33/02* (2013.01)

(58) Field of Classification Search
CPC ..... F42B 12/38; F42B 10/02; F42B 12/76; F42B 7/00; F42B 12/387; F42B 7/08; G01S 13/723; G01S 13/765; G01S 5/0027; G01S 5/14; F41C 7/00
USPC ..... 102/513, 458, 449, 346
See application file for complete search history.

(56) References Cited

U.S. PATENT DOCUMENTS 4,635,555 A * 1/1987 Ferri ..... F42B 7/08 102/453
5,299,502 A * 4/1994 Maki ..... F42B 7/08 102/449
6,539,873 B2 4/2003 Diller
6,694,887 B2 * 2/2004 Diller ..... F42B 7/08 102/449
6,886,468 B2 5/2005 Diller
7,171,904 B2 2/2007 Diller
7,174,833 B2 2/2007 Diller
7,908,972 B2 * 3/2011 Brunn ..... F42B 4/26 102/346
8,561,542 B2 * 10/2013 Authement, Sr. ..... F42B 12/40 102/459
8,919,255 B1 * 12/2014 Quintana ..... F42B 12/38 102/449
2005/0188882 A1 * 9/2005 Diller ..... F42B 7/08 102/458
2009/0053678 A1 * 2/2009 Falkenhayn ..... F41A 33/00 434/16
2013/0042783 A1 * 2/2013 Diller ..... F42B 7/04 102/513
2013/0055916 A1 * 3/2013 Menefee, III ..... F42B 7/08 102/334

* cited by examiner

*Primary Examiner* — Troy Chambers
*Assistant Examiner* — Bridget Cochran
(74) *Attorney, Agent, or Firm* — Vidas, Arrett & Steinkraus

(57) ABSTRACT

A shotgun shell tracer includes a base wall, an obturator, and an edge wall extending from the base wall opposite to the obturator. A chamber support may be engaged to the base wall extending from the base wall within the internal space of the tracer. The shotgun shell tracer may additionally include a tracer insert which may encircle the chamber support. Discharge of a shotgun shell in some embodiments will exert pressure on projectiles which fuse the tracer insert to the base wall and the chamber support, and embed the projectiles into the tracer insert, establishing ballast for the shotgun shell tracer. The chamber support in one embodiment may be a modified spike. The ballast in one embodiment may be a washer replacing embedded projectiles. A conveyor may be used to transport tracer carriers during manufacture of a tracer.

20 Claims, 4 Drawing Sheets

SHOTGUN SHELL TRACER AND TRACER MANUFACTURING DEVICE

CROSS REFERENCE TO RELATED APPLICATIONS

This application claims the benefit of U.S. Provisional Patent Application Ser. No. 61/777,485 filed Mar. 12, 2013 which is incorporated by reference herein in its entirety.

Applicant incorporates by reference herein in their entireties commonly owned U.S. Pat. No. 7,174,833, Shotgun shell flight path indicator; U.S. Pat. No. 7,171,904, Shotgun shell flight path indicator; U.S. Pat. No. 6,886,468, Shotgun shell flight path indicator; U.S. Pat. No. 6,694,887, Shotgun shell flight path indicator; U.S. Pat. No. 6,694,887 Shotgun shell flight path indicator; U.S. Pat. No. 6,539,873 Shotgun shell flight path indicator, and U.S. patent application Ser. No. 13/570,443, Shotgun Tracer.

BACKGROUND

Brightly colored tracers become dulled by the flame, smoke, and/or soot from a shotgun barrel and/or ignited gunpowder during discharge of a shotgun shell tracer. The dulling of the color of the tracer degrades an individual's ability to detect the tracer in flight, particularly against certain backgrounds.

In the past manufacturing efficiencies in the formation of shotgun shell tracers has been difficult to obtain. The number of manufacturing challenges increase as different materials are used to form a shotgun shell tracer body. The number of manufacturing challenges also increases as different sizes and types of shot are incorporated into a shotgun shell tracer. Some manufacturing considerations include, but are not necessarily limited to, a one piece or two piece design, the materials used for the tracer insert, the dimensions and configurations for the components of the tracer insert, as well as the performance of the tracer following setback or discharge to provide a desired level of visibility as well as accurate and consistent flight trajectory performance. Some types of shot perform better within a shotgun shell tracer as compared to other types of shot. Some types of shot also provide an acceptable level of performance as ballast for a shotgun shell tracer, while other types of shot underperform relative to expectations for ballast for a shotgun shell tracer.

SUMMARY

In one alternative embodiment a shotgun shell tracer may include at least one base wall, at least one obturator extending from the base wall, at least one edge wall extending from the at least one base wall opposite to the obturator, the at least one edge wall defining an internal space and at least one ballast chamber support engaged to the at least one base wall wherein the at least one ballast chamber support extends from the at least one base wall within the internal space.

In an alternative embodiment the shotgun shell tracer may additionally include at least one tracer insert which may be constructed and arranged to encircle the at least one ballast chamber support within the internal space, where the at least one tracer insert is not integral to the at least one ballast chamber support prior to discharge of the shotgun shell tracer. Discharge of a shotgun shell including the shotgun shell tracer exerts pressure on projectiles which fuse the at least one tracer insert to at least one of the base wall and/or the ballast chamber support, and embed the projectiles into the at least one tracer insert, establishing ballast for the shotgun shell tracer.

In an alternative embodiment the at least one ballast chamber support may additionally include a ledge and the at least one tracer insert includes a lower edge where the lower edge is positioned proximate to the ledge.

In an alternative embodiment the tracer insert may include a lower edge and a bevel opposite to the lower edge. In some embodiments the bevel may extend away from the at least one edge wall inwardly toward the interior space of the tracer.

In an alternative embodiment the at least one ballast chamber support may include ballast. In an alternative embodiment the at least one ballast chamber support may include at least one post and the post may include the ballast or the post may be constructed and arranged to function in association with the ballast. In an alternative embodiment the ballast may be positioned between the post and the at least one edge wall. In an alternative embodiment the ballast may include at least one arcuate segment. In an alternative embodiment the at least one arcuate segment may form a ring or may be a washer.

In an alternative embodiment the at least one edge wall may include an exterior, and the shotgun shell tracer may further include at least one protective cup or sleeve disposed to the exterior of the at least one edge wall. In some embodiments the at least one protective cup or sleeve may separate from the exterior of the at least one edge wall upon exit from a shotgun barrel following discharge of the shotgun shell tracer.

In an alternative embodiment the at least one edge wall may include an exterior, and the shotgun shell tracer may further include at least one protector disposed about the exterior of the at least one edge wall. In some embodiments the at least one protector may be formed of film. In some embodiments the at least one protector may separate from the exterior of the at least one edge wall upon exit from a shotgun barrel following discharge of the shotgun shell tracer.

In one alternative embodiment a shotgun shell tracer may be formed by molding at least one base wall, at least one obturator, at least one edge wall, the at least one edge wall defining an internal space into a tracer body; inserting the tracer body into a tubular carrier which in some embodiments may be metallic; transporting the tubular carrier having the tracer body to a loading device which may be used to insert the tracer body into a shotgun shell casing and separating the tracer body from the tubular carrier; and releasably securing the tubular carrier to a conveyor device, where the conveyor device may include a plurality of regularly spaced pockets, magnetic elements or other attachments devices, each of the regularly spaced engagement elements may magnetically engage or releasably secure the tubular carrier to return the tubular carrier for insertion of another tracer body.

DETAILED DESCRIPTION

Figure 1:
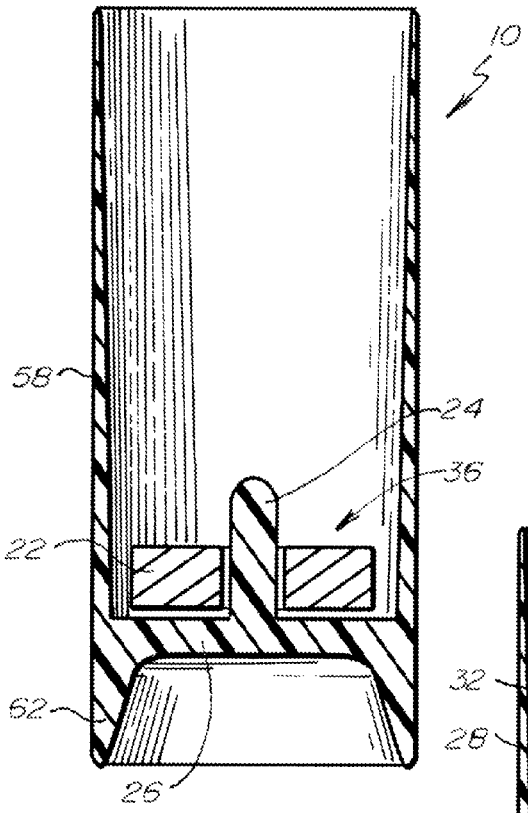
FIG. 1 is a cross-sectional side view of one alternative embodiment of a shotgun shell tracer.

In at least one embodiment, the invention is directed to a 2-piece tracer design where the tracer is generally identified by reference numeral 10. In at least one embodiment, the 2-piece design includes a tracer body having a ballast chamber support 38 and a structurally independent tracer insert 30 disposed over the structural elements 40 of the ballast chamber support 38. The ballast chamber support 38 extends upwardly from a base 26 centrally within the interior of the tracer 10 as defined by tracer wall 58. In some embodiments, the tracer body includes the base 26, an obturator 62 extending downwardly from the base 26, a ballast chamber support 38 extending upwardly from the base 26, and the tracer wall 58 extending upwardly from the base 26 exterior to the ballast chamber support 38. In some embodiments the ballast chamber support 38 is disposed centrally relative to the tracer wall 58. In general, the reference to the 2-piece design is referring to an embodiment where the tracer insert 30 is a separate and distinct structural element relative to the ballast chamber support 38, where the tracer insert 30 is formed by a separate and distinct manufacturing process as compared to the manufacture of the tracer body.

In at least one embodiment, as shown in FIG. 1, any shaped high-density, medium density or low density ballast material 22 may be press-fit over a center post 24. The center post 24 may be integral to the base 26 or in alternative embodiments, the center post 24 may be a separate element which may be positioned above or below the base 26 of the tracer 10. In at least one embodiment the ballast 22 may be formed of arcuate segments and in alternative embodiments the ballast may be washer shaped. (FIG. 1) In some embodiments the ballast 22 may be formed of metal such as steel, or other dense material which may be plastic or composite materials. In some embodiments, the ballast chamber support 38 and/or the tracer insert 30 may include or be impregnated with metal, waste metal, steel, or a mixture of any of the above or other metallic or non-metallic materials.

In at least one embodiment as depicted in FIG. 1, the tracer 10 includes a center post 24 and a steel or other metallic washer 22 positioned around the center post 24, within the interior of the tracer wall 58. In other embodiments, the ballast 22 is not required to be a singular unitary structure of a washer and may be formed of sections or parts which may be arcuate in shape. In this embodiment one or more pieces of arcuate shaped metal or other material may be disposed around the center post 24 between the center post 24 and the tracer wall 58.

In at least one embodiment, the elevation of the tracer insert 30 relative to the ballast chamber support 38 or with respect to the base 26 may be varied in order to facilitate the use of various sized shot 34. Elevation of the tracer insert 30 relative to the base 26 may permit shot 34 to more easily flow into the ballast cavity 36 during loading of shot 34 into the shotgun shell.

In at least one embodiment, as an alternative to replace the feature of capturing shot 34 as ballast 22, either the ballast chamber support 38 or the tracer insert 30 may be formed of a different material, or especially a composite material, which may have sufficient density to function as ballast 22. The material, density and/or properties of the materials selected for the ballast chamber support 38 or the tracer insert 30, which may be used as ballast 22, may be based on the overall performance considerations for the tracer 10.

In at least one embodiment, the materials selected for the ballast chamber support 38 or the tracer insert 30, which may be used as ballast 22 upon setback, and may be formed of a mix or steel waste material from one or more peening processes with plastic or resin, or combinations thereof. In at least one embodiment the materials selected for the ballast chamber support 38 or the tracer insert 30 may be selected to reduce shot-capturing by the ballast chamber support 38 or the tracer insert 30. In an alternative embodiment the ballast chamber support 38 or the tracer insert 30 may be formed of an extruded (inexpensive) material or materials. The materials selected for the ballast chamber support 38 or tracer insert 30 may have sufficient density or properties so that the ballast chamber support 38 or the tracer insert 30 may independently function as ballast 22, eliminating the need for shot-capturing by the ballast chamber support 38 or the tracer insert 30. In some embodiments, the ballast chamber support 38 and/or the tracer insert 30 may be formed of composite materials or variable density materials.

In an alternative embodiment the ballast 22 may formed of a mix of steel waste material from one or more peening processes with plastic or resin, or combinations thereof, and may be formed into a spike or post 46 which is then disposed centrally though the base 26. The spike or post 46 may have sufficient density to function as ballast 22 to eliminate the necessity for shot-capturing by the ballast chamber support 38 or the tracer insert 30. In an alternative embodiment the spike or post 46 may be formed of metal, and may include a head 48, shank 50 and point 52. (FIG. 3) In at least one embodiment as depicted in FIG. 3 a post 46 may be used in substitution of the ballast chamber support 38 or in an alternative embodiment as the ballast 22 for the tracer 10.

In at least one embodiment, if shot-capturing is not required or desired, then the ballast chamber support 38 may be a post 46 which may be used in association with a tracer insert 30. For example, in the case of larger steel shot 34 sizes, shot capturing may function optimally or be desired in view of spatial considerations. In an alternative embodiment a post 46 may be preferred or a post 46 and tracer insert 30 combination.

In at least one embodiment, the post 46, may be formed by modifying a nail. In at least one embodiment, a steel or other metallic washer may function as the ballast 22 where the washer may be press-fitted on the center post 24 or the base 26. In some embodiments for a tracer 10 having a 2-piece design, the use of a center post 24, post 46, washer as ballast 22, or other ballast 22 material, may be utilized in order to optimize cooling and cycle time during the manufacturing molding process of the tracer 10.

Figure 3:
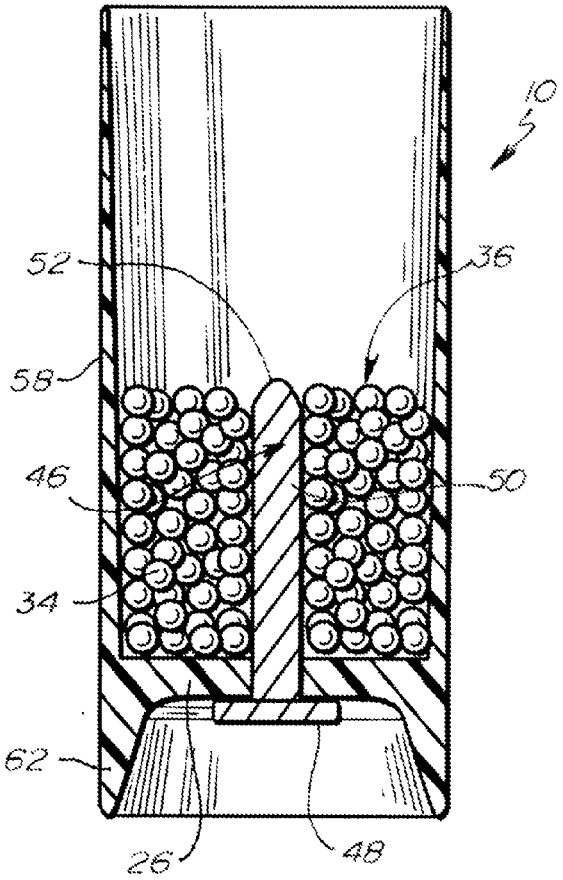
FIG. 3 is a cross sectional side view of one alternative embodiment of a shotgun shell tracer holding projectiles.

In an alternative embodiment as depicted in FIG. 3, a center post 46 is depicted which traverses the base 26 of the tracer 10. In this embodiment the center post 46 may be formed of sufficiently dense material to function as ballast 22 for the tracer 10. In an alternative embodiment, the materials selected for the tracer 10 and the center post 46 may be sufficiently dense to function in combination as ballast 22 for the tracer 10 during use.

It should be noted that in some embodiments the width and/or the height dimensions for the center post 24 may be increased or decreased as desired to manipulate the amount of ballast 22 used to alter the aerodynamic performance of the tracer 10. In some embodiments, the dimensions selected for the center post 24 may compliment the dimension selected for the size and/or type of shot 34 used in a shotgun shell. In some embodiments, the dimensions selected for the center post 24 increase or decrease the amount of shot 34 disposed within the tracer 10 to adjust the aerodynamic flight or performance of the tracer 10.

It should also be noted that in some embodiments, the width, height, and/or density of the post or pike 46 may be increased or decreased as desired in order to manipulate the amount of ballast 22 used to alter the aerodynamic performance of the tracer 10. In some embodiments, the dimensions selected for pike 46 may compliment the dimensions selected for the size and/or type of shot 34 used in a shotgun shell. In some embodiments, the dimensions selected for the pike 46 increase or decrease the amount of shot 34 disposed within the tracer 10 to adjust the aerodynamic flight or performance of the tracer 10.

Further, in some embodiments, the length width, and/or thickness dimensions of the structural elements 40 of the ballast chamber support 38 may be increased or decreased as desired to manipulate the amount of ballast 22 captured in a two-piece design to alter the aerodynamic performance of the tracer 10, which may hold various sizes and/or types of shot 34.

In at least one embodiment, the tracer 10 may include one or more petal notches or slits 56 forming petals 54. In an alternative embodiment, instead of a notch or slit 56 in the petal 54, if upper end of the tracer wall 58 or conventional petal 54 is extremely thin as compared to the lower portion of the tracer wall 58 or petal 54, then upon discharge or setback the sidewall 58 may deform to provide an asymmetrical shape during flight, which would provide the desired aerodynamic effects and function for the tracer 10. In this embodiment, the tracer 10 may experience improved rotation or drag stabilization or alternatively may act as a pilot chute for consistent opening of the petals 54 following discharge of a shotgun shell.

In some embodiments, the mouth or opening 32 of the tracer insert 30 may be enlarged for use with alternative types or sizes of shot 34. In some embodiments, the interior chamber of the tracer 10 may need to be enlarged for use with steel shot 34, because steel shot 34 is less dense (and larger) than standard lead shot 34, and because the tracer wall 58 in some embodiments is as short as possible, therefore, the interior chamber of the tracer 10 should be as large as possible in order to accommodate a desired volume of steel shot 34.

In some embodiments, if the dimension of the mouth or opening 32 of the tracer insert 30 is more than approximately two times the diameter dimension of the shot 34, then the shot 34 may not operatively lock or become impregnated with the ballast chamber support 38 or the tracer insert 30 during setback upon the discharge of a shotgun shell. The increased dimension for the mouth or opening 32 for the tracer insert 30, and the absence of deformity to the tracer insert 30 caused by steel shot 34 during setback, reduces the likelihood that the steel shot 34 will compact together. The absence of compaction and deformity of steel shot 34 results in a larger percentage of the shot 34 being expelled from, or falling out of, the ballast cavity 36, or interior chamber of the tracer 10.

Figure 2:
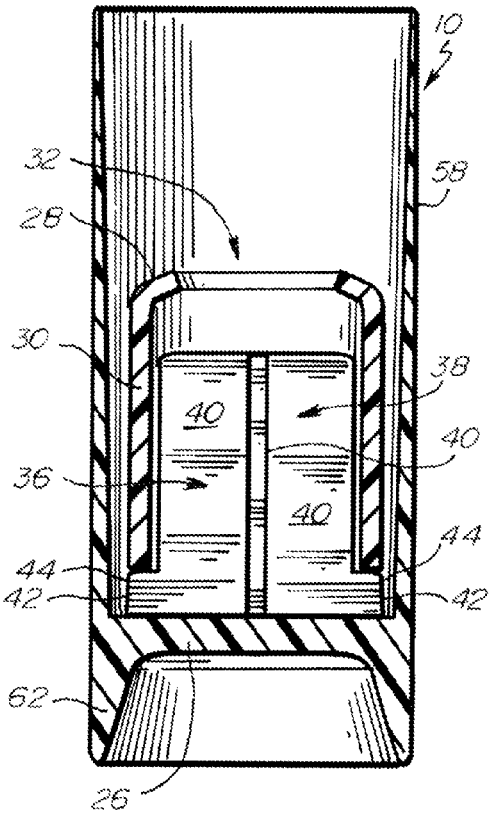
FIG. 2 is a cross-sectional side view of one alternative embodiment of a shotgun shell tracer.

In some embodiments it is anticipated that the tracer 10 will include a cylindrical or tubular shaped tracer insert 30. In some embodiments, the tracer insert 30 will be formed of plastic material, composite material, combinations of plastic and composite material or other materials, which may be formed through an extrusion manufacturing process, or which may be formed of another type of manufacturing process as desired, based on economic and/or convenience considerations. The tracer insert 30 is depicted in FIG. 2 herein.

In some embodiments, the tracer insert 30 includes a top beveled edge 28, a bottom edge, an inner wall, an outer wall, and a centrally disposed opening. The tracer insert 30 is preferably cylindrically tubular in shape. The thickness dimension between the inner wall and the outer wall may vary depending on the density and properties of the material selected for the tracer insert 30, and is based on desired performance considerations for the tracer 10.

In at least one embodiment, the tracer insert 30 may be formed of plastic and/or cut from plastic tubing to a desired length, and may function to capture shot 34. In some embodiments one end of the tracer insert 30 is stamped to form the bevel 28. The dimensions for the bevel 28 may be selected to satisfy, and to accommodate, the requirements of a specific type or size of shot 34 within a shotgun shell tracer. In at least one embodiment the diameter, thickness and/or length dimensions selected for the tracer insert 30 may be modified to enlarge or to reduce the size of the ballast cavity 36, in order to accommodate the use of different sized or types of shot 34 within the tracer 10.

In at least one embodiment, an insert machine may be used to first press a bevel 28 on the mouth or upper end of a tracer insert 30. In some embodiments, the size of the opening 32 or upper end for the tracer insert 30 may be varied to accommodate insertion of different sizes of ballast 22 or shot 34 for entry into the ballast cavity 36, and the areas adjacent to the structural elements 40. The shot 34 adjacent to the tracer insert 30 and/or the structural elements 40 may be entrapped as ballast 22 upon setback or upon ignition of the shotgun shell.

In at least one embodiment, the bevel 28 and the predisposition of the opening 32 in the tracer insert 30 aids and ensures better entrapment of the ballast material 22 upon setback of the shot upon ignition of a shotgun shell.

In at least one embodiment, the tracer insert 30 is disposed at least partially over the ballast chamber support 38, where the tracer insert 30 may include a bevel 28 applied to the mouth or opening of the tracer insert 30. The bevel 28 may allow the shot 34 to pass through the narrowed mouth or opening 32 of the tracer insert 30 in order to fill in the larger ballast cavities 36 within the interior of the tracer 10. In at least one embodiment, during the setback from ignition of the shotgun shell, the bevel 28 is deformed, further closing off the mouth or opening into the tracer insert 30 in order to capture shot 34 as ballast 22.

In at least one embodiment, the opening 32 defined by the beveled edge 28 is sufficient in size to enable shot 34 to be disposed proximate to the ballast chamber support 38, between the ballast chamber support 38 and the cylindrical tracer insert 30. It should be noted that the vertical dimension selected for the wall of the cylindrical tracer insert 30 may vary, and in some embodiments, may be dependent upon the height dimension selected for the edge 44 of the ledge 42.

In at least one embodiment, ignition of the shotgun shell causes setback which in turn causes the tracer insert 30 to fully seat relative to the base 26 and to narrow the opening 32 to the ballast cavity 36 to further aid in the entrapment of the shot 34 as ballast 22. In at least one embodiment, at least one step or ledge 42 may be formed or molded into the lower portion or edge 44 of the center post or ballast chamber support 38. In at least one embodiment, the at least one step or ledge 42 may be used to provide a consistent elevation for the tracer insert 30 relative to the base 26.

In at least one alternative embodiment, the ballast cavity 36 may be temporarily enlarged by slightly elevating the tracer insert 30 relative to the ballast chamber support 38, and the base 26 of the shotgun shell tracer 10. During setback, the tracer insert 30 may be forced to descend toward the base 26 in order to improve the closure of the mouth or opening 32 for tracer insert 30 and/or the tracer 10.

In at least one embodiment as depicted in FIG. 2, the ballast chamber support 38 may include a circumferential ledge. The height dimension for the circumferential edge 44 may vary dependent upon the size of the shotgun shell and/or shot 34 to be included within the shotgun shell, or the materials used to form the tracer 10.

In some embodiments, the location of the center-of-pressure exposed to a tracer 10 during flight is an engineering factor used to stabilize the flight path of the tracer 10. An increase in the frontal area of the base 26 of an aerodynamic tracer 10 will move the center-of-pressure forward for better aerodynamic stability. Maximum frontal area of the base 26 of the tracer 10 may be achieved by increasing the thickness of the walls 58 to the maximum width of the cylindrical exterior barrier or wall of a shotgun shell, when the tracer 10 is inserted into the shotgun shell.

In some embodiments, increasing the frontal area of the tracer 10 provides the option to either improve accuracy of the tracer 10 or to shorten the overall length of the tracer 10 to increase the internal volume for a greater load of shot 34. Shortening of the length of the tracer 10 will degrade stability and accuracy. Alternatively, improvement in stability provided by the increased frontal area may offset the loss of stability of a shorter tracer length.

In at least one embodiment, the tracer 10 may be sufficiently flexible to enable use with steel or hunting loads. In at least one embodiment, the tracer 10 which may include, or be formed in a 2-piece design, may be suitable for use with steel shot 34 and/or hunting tracers as compared to target tracers.

In at least one embodiment, the tracer 10 incorporating the 2-piece design may improve load capacity, flexibility for different shot shells, and provide molding advantages for the tracer body during the manufacturing process. In addition, the 2-piece design may be flexible and may not require retooling during the manufacturing process.

In another embodiment, the visibility of tracer 10 is improved through the utilization of a protective acetate carrier or shield 18 for use with the orange tracer 10. A black tracer 10 against a sky background may be more visible in certain environments than the orange tracer 10 against a sight line including trees or earthen backdrop.

In at least one embodiment, a shield 18 may be formed of a protective film and may be used in conjunction with an orange tracer 10. In some embodiments following the discharge of a shotgun shell including a tracer, the brilliance of brightly-colored tracers 10 will become dulled by the flame and smoke from the gun powder of a shotgun shell and soot in the gun barrel, which degrades the ability to detect the tracer 10 in flight. A protective carrier 18 or covering which may separate from a tracer 10 upon exiting the muzzle of a shotgun barrel may ensure a clean and bright color for the tracer 10 during flight. Alternatively, the protective carrier 18 may be formed of a material which does not pick up smoke or soot following ignition of gunpowder and use of a tracer 10 in association with a shotgun shell or shotgun barrel. In some embodiments, either an applied protective coating, a separate carrier cup 20, or an acetate or plastic film 18 may be used to protect the appearance of a tracer 10 which may separate from the tracer 10 upon exiting the muzzle of the barrel of a shotgun.

In at least one embodiment, the material utilized for a roll-fed protective carrier or shield 18 may be acetate, plastic or other suitable coating material. The roll-fed protective carrier or shield 18 may be incorporated into the tracer 10 through the use of a conveyor belt 14 and stuffer mechanism.

In at least one embodiment the shield 18 may be disposed on the exterior of the tracer 10 by dipping of the tracer 10 in a substance or by spraying of a coating on the exterior of the tracer 10. In at least one alternative embodiment the shield 18 may be applied to the exterior of the tracer 10 as a separate manufacturing operation prior to the loading of the tracer 10 within a shotgun shell.

In at least one embodiment, acetate or plastic film may form the shield 18, where the acetate or plastic film may be wrapped around the tracer 10. (FIGS. 5*a*, 5*b* and 6) The use of the acetate or plastic film as the shield 18 may provide a relatively low-cost method for protection of the exterior of an orange or other color of tracer 10.

In at least one embodiment, the tracer 10 includes a protective film 18 and a tracer insertion machine is used to press a roll-fed film 18, and the tracer 10, and into a carrier tube 12 prior to the feeding of the tracer 10 into the loading machine. After the loading machine has inserted the tracer 10 and film 18 into the shotgun shell, the carrier tubes 12 will be ejected from the loading machine and recycled back into a container for reuse in the transport of another tracer 10 and/or shield 18 in order to repeat the manufacturing cycle.

In at least one embodiment, the invention provides a continuous conveyor belt 14 with high-strength magnets 16 which are regularly spaced and engaged to the conveyor belt 14 for transporting metallic carrier tubes 12 to and from the insertion and loading machines for the shotgun shell. In some embodiments, other forms of conveyance of the carrier tubes 12 may include feeder tubes or rails. In some embodiments, the carrier tubes 12 are formed of metallic materials, plastic materials, carbon materials, and/or other materials or combinations thereof.

In at least one embodiment the shield 18 protects and/or preserves the color of an orange or other colored tracer 10. In some embodiments the shield 18 may be formed of one, two, or more strips 60 of acetate or other suitable protective material which may be disposed to the exterior of the tracer 10. (FIGS. 5*a*, 5*b*, and 6)

Figure 5A:
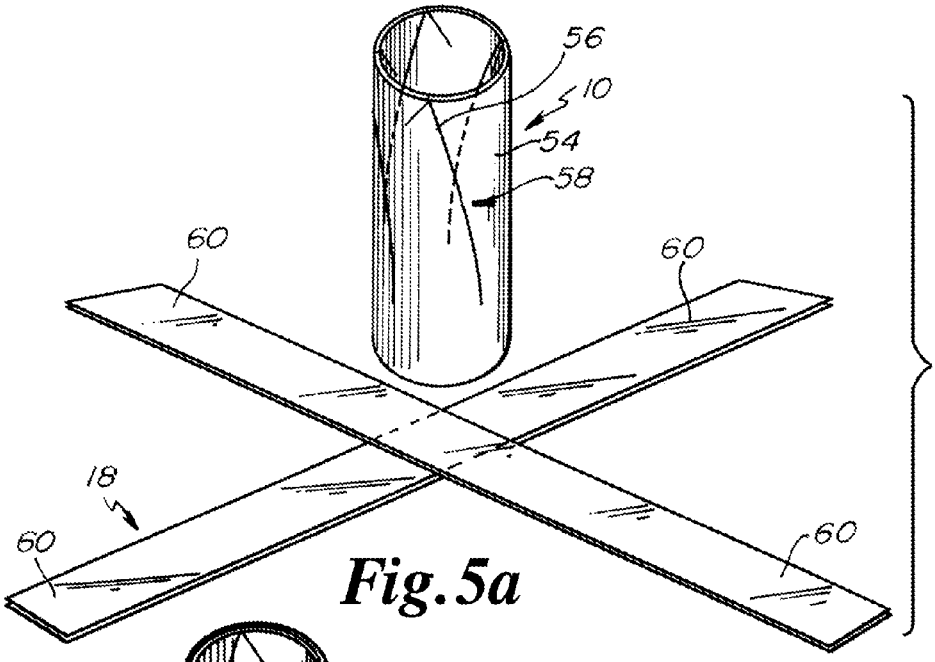
FIG. 5*a* is an exploded isometric view of one alternative embodiment of a shotgun shell tracer and one alternative embodiment of a protective shield.
Figure 5B:
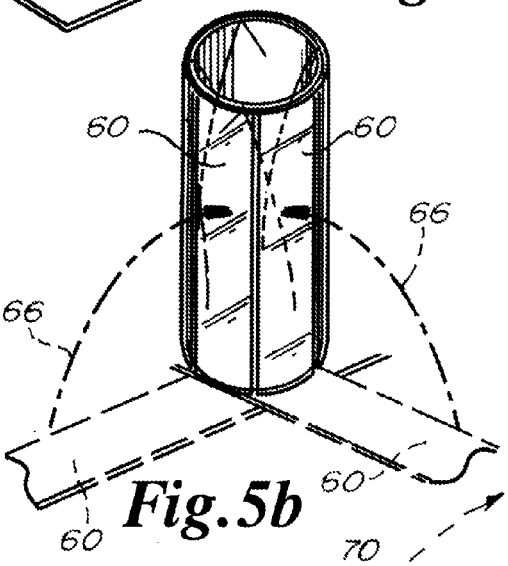
FIG. 5*b* is an isometric partial phantom line view of one alternative embodiment of a shotgun shell tracer and one alternative embodiment of a protective shield as depicted in FIG. 5*a* as disposed in an operative position.

In an alternative embodiment as depicted in FIG. 5*a*, two portions of acetate film may be disposed to the exterior of the tracer 10 to function as a shield 18. In at least one embodiment, the film portions of acetate may be disposed at right angles relative to each another. In some embodiments the intersection of the pieces of film is located proximate to the base 26 or obturator 62 of the tracer 10, where the film extends upwardly to wrap around the exterior of the tracer 10 as depicted by arrows 66 of FIG. 5*b*. It should be noted that the width dimension selected for the film is preferably sufficiently large so that one portion of film will cover approximately ¼ of the circumference of the exterior surface of the tracer wall 58. It should be noted that the portions of film are preferably sufficiently large to extend from the bottom to the top of the tracer wall 58.

Figure 6:
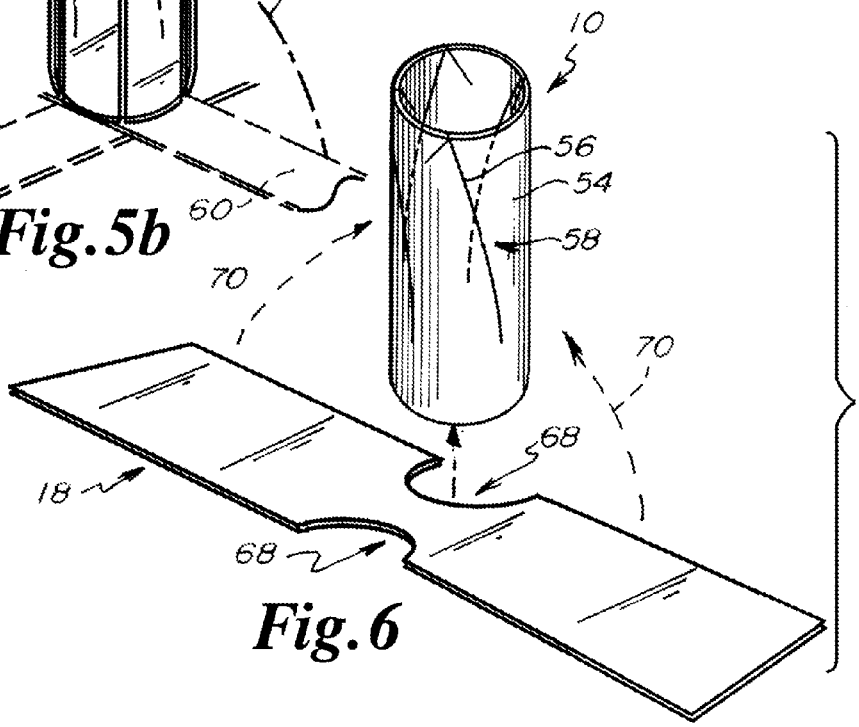
FIG. 6 is an exploded isometric view of one alternative embodiment of a shotgun shell tracer and one alternative embodiment of a protective shield.

In an alternative embodiment as depicted in FIG. 6, one portion of acetate film may be disposed to the exterior of the tracer 10 to function as a shield 18. In this embodiment, the portion of film includes a pair of opposite central cutaway sections 68, where each of the end portions of the film are constructed and arranged to extend upwardly to wrap about the exterior of the tracer 10 as depicted by arrows 70. It should be noted that the width dimension selected for the film is preferably sufficiently large so that each opposite end portion of the film will cover approximately ½ of the circumference of the exterior surface of the tracer wall 58.

In at least one embodiment a carrier cup 20 may be positioned so that a tracer 10 may be inserted into the interior of the carrier cup 20. The insertion of the tracer 10 into the carrier cup 20 may occur as a preliminary manufacturing step, or substantially simultaneously with, the insertion of the tracer 10 into the shotgun shell during the loading operation.

Figure 4:
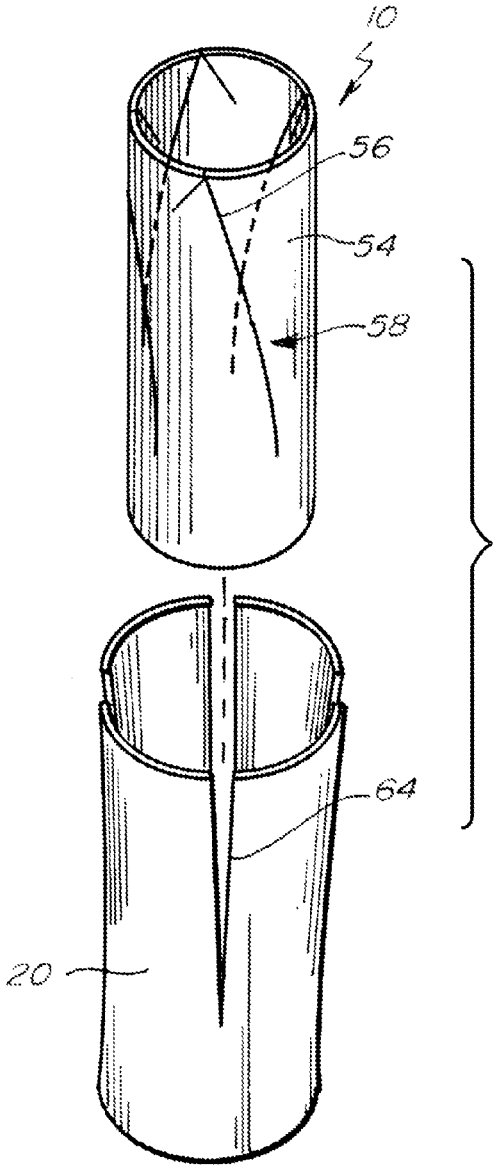
FIG. 4 is an exploded isometric view of one alternative embodiment of a shotgun shell tracer and one alternative embodiment of a protective carrier cup.

In an alternative embodiment as depicted in FIG. 4, a protective cup 20 or shield may be disposed to the exterior of the tracer 10. The protective cup 20 or shield may be formed of acetate, plastic, other materials and/or combinations thereof. In at least one embodiment, the protective cup 20 or shield may include vertical slits 64 to facilitate separation of the protective cup 20 or shield from the tracer 10 following discharge from a shotgun. In at least one embodiment the protective cup 20 or shield may be substantially cylindrical in shape.

Figure 7:
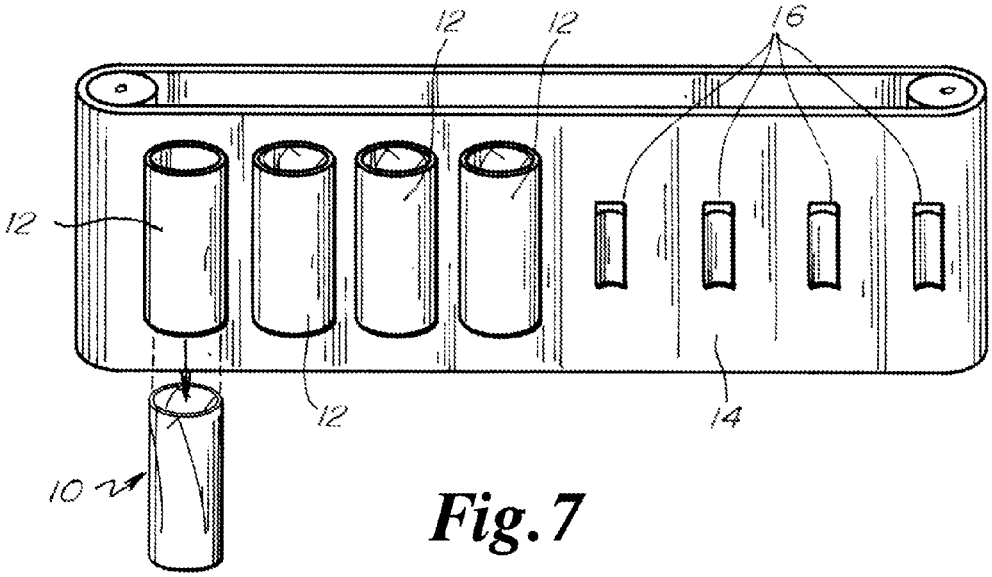
FIG. 7 is an environmental partial exploded view of one alternative embodiment of a carrier tube for a shotgun shell tracer and conveyor assembly.

In at least one embodiment, the manufacturing process for the two-piece tracer 10 may include feeder bowls which are located above high-speed loaders. The tracer bodies may be either fed down a rail system or a tube to the loaders. In at least one embodiment a 2-piece tracer 10 may be transported in a metallic or non-metallic carrier tube 12 which may be sent down the tube to the loader. In some embodiments, the metallic carrier tube 12 preferably has magnetic properties. The loader may separate the tracer 10 from the interior of the carrier tube 12, whereupon a conveyor belt 14, which in some embodiments may be embedded rare-earth magnets 16, may grasp and recycle the carrier tubes 12 for reuse as shown in FIG. 7. In at least one embodiment the conveyor belt 14 and a machine would be utilized to stuff the 2-piece tracer 10 into the interior of a carrier tube 14.

In at least one embodiment, carrier tubes 12 having any desired thickness may function as transport carriers for the tracers 10, or tracers and shields or film 18, as moved between manufacturing or loading operations. In other embodiments, the carrier tubes 12 may transport wads or other devise which are not easily loaded into a high-speed loading machine.

In at least one embodiment a partial manufacturing process is depicted in FIG. 7. The manufacturing processes uses a continuous belt 14 having magnets or grasping elements 16 which are constructed and arranged to releasably secure the carrier tubes 12 used in the loading and manufacturing process for the two-piece tracer 10.

In at least one alternative embodiment, the tubes or carriers 12 may be manufactured and at least one outboard machine may be used to insert the tracers 10 into the interior of the carriers 12. This manufacturing process would replace the use of multiple outboard machines running in parallel. The metallic or plastic carriers 12 may be more economically efficient than carriers 12 constructed of alternative materials.

In some embodiments, a shotgun shell manufacturing process may use progressive in-line or turret style loading machines which are constructed for high speed and efficiency, in order to reduce manufacturing costs of a shotgun shell and tracer 10. In some embodiments, the progressive in-line or turret style loading machines may be a closed system and not intended for customization, or for use with unusual shotgun shell components. Consequently, the shotgun shell engineer is limited in shotgun shell component designs which are compatible with these commercial progressive in-line or turret style loading machines described herein.

In at least one embodiment, the method of manufacture utilizes a detachable carrier 12 to transport a tracer 10 from an in-line or turret custom tracer loading machine to a commercial progressive in-line or turret shotgun shell loading machine. In at least one embodiment, the detachable carrier 12 transport tracers 10 of varying designs in progressive in-line or turret shotgun shell wad loading machines. The detachable carrier 12 may be transported from the shotgun shell loading machine to the commercial carrier loading machine for insertion of the tracer 10 from the carrier 12 into the shotgun shell hull. The empty detachable carrier 12 may then be transported back to the custom shotgun shell tracer 10 loading machine for reuse.

In at least one embodiment, the carrier tube 12 holding a tracer 10 is transported by the conveyer 14 to a turret assembly or loader which separates the tracer 10 from the carrier tube 12 for insertion into the exterior casing for the shotgun shell. In some embodiments, the carrier tube 12 may be separated from the conveyer 14 when the tracer 10 is removed from the carrier tube 12, then the empty carrier tube 12 may fall into a container (not shown). In some embodiments, the container holding a plurality of empty carrier tubes 12 may be moved to a location proximate to a hopper whereupon the container may be emptied placing the empty carrier tubes 12 into the hopper. The orientation of select carrier tubes 12 in the hopper are then manipulated into a position to engage a conveyer 14 for transportation to a turret or loading machine where upon a tracer 10, wad, or other device is mechanically disposed within the interior of the carrier tube 12. The conveyer 14 then transports the carrier 12 and tracer 10 to the turret loading assembly for placement of the tracer within a shotgun shell. In alternative embodiments, additional feeder tubes, turret assemblies, conveyers, and loading devices may be used to transport the carrier tubes 12 to a desired manufacturing location. The use of the carrier tube 12 to transport the tracer 10, significantly improves the manufacturing process as compared to manipulation and handling of plastic, lightweight tracers 10. In this embodiment, the carrier tubes 12 are reusable during the manufacturing process facilitating ease of use and reducing manufacturing costs while improving manufacturing speed.

In some embodiments, a turret moves a tracer 10 from one station to the next for various operations. One of the intermediate operations may be the insertion of the tracer insert 30 over the ballast chamber support 38 prior to the loading of the shotgun shell with projectiles or shot 34.

In some embodiments, during the manufacturing process the shields 18 may be disposed proximate to and over the top of a carrier tube 12 at an operational stage prior to the downward insertion of the tracer 10 into the carrier tube 12. In some embodiments, the downward manipulation of the tracer 10 onto the shield 18 causes the ends of the shield 18 to fold upwardly as shown by arrow 66 of FIG. 5*b* as the tracer 10 is pressed or manipulated downwardly for insertion into the interior of the carrier tube 12. In some embodiments, the complete insertion of the tracer 10 within the interior of the carrier tube 12 causes the shield 18 to fold upwardly for positioning adjacent to the exterior of the tracer wall 58. The carrier tube 12 may then be transported to another operational location where the tracer 10 is manipulated downwardly out of the carrier tube 12 into the interior casing of a shotgun shell. In at least one embodiment, the immediate downward movement of the tracer 10 out of the carrier tube 12 and into the casing of a shotgun shell does not permit the shield 18 to separate from the exterior of the tracer wall 58 so that the shield 18 is disposed in between the tracer wall 58 and the interior wall of the casing of a shotgun shell. The above described manufacturing steps may be repeated for use of a shield 18 as depicted in FIG. 6.

The manufacturing process for at least one embodiment as depicted in FIG. 4 may include an intermediate step of molding or otherwise forming the carrier cup 20. In some embodiments, the carrier cup 20 is disposed over the top of the carrier tube 12 in substitution for the shield 18. In some embodiments, the tracer 10 is pressed downwardly into the cup 20, which in turn is disposed downwardly into the interior of the carrier tube 12. The carrier tube 12 transporting the tracer 10 and cup 20 may then be transported by a conveyer 14 and grasping elements 16 to a position above a shotgun shell casing, for downward separation, where the wall or sides of the cup 20 are disposed in between the exterior of the tracer wall 58 and the interior of the carrier tube 12. The positioning and alignment of the carrier tube 12 over the shotgun shell casing permits the tracer 10 and cup 20 to be disposed downwardly immediately into the shotgun shell casing.

In at least one embodiment, the carrier tubes 12 provide for the efficient and flexible manufacturing process, which in turn facilitates subtle engineering modifications of the tracer 10 to improve performance while simultaneously minimizing manufacturing constraints occurring during use of high-speed feeding machines or feeder bowls. For example, satellite loading machines may insert propellant into a shotgun shell casing prior to the assembly operation where the tracer 10 is disposed into the shotgun shell casing. In some embodiments, the use of the carrier tube 12 improves the transport of delicate or inconsistent tracer parts which may otherwise cause a jam in a high-speed loading machine.

In a first alternative embodiment a shotgun shell tracer includes: at least one base wall, at least one obturator extending from the at least one base wall, at least one edge wall extending from the at least one base wall opposite to the obturator, the at least one edge wall defining an internal space; at least one chamber support engaged to the at least one base wall wherein the at least one chamber support extends from the at least one base wall within the internal space.

In a second alternative embodiment according to the first alternative embodiment, the shotgun shell tracer may further include at least one tracer insert which may be constructed and arranged to encircle the at least one chamber support within the internal space, the at least one tracer insert not being integral to the at least one chamber support prior to discharge of the shotgun shell tracer wherein discharge of a shotgun shell comprising the shotgun shell tracer exerts pressure on projectiles which fuse the at least one tracer insert to at least one of the base wall and the chamber support, and embed the projectiles into the at least one tracer insert, establishing ballast for the shotgun shell tracer.

In a third alternative embodiment according to the second alternative embodiment, the at least one chamber support may include a ledge and the at least one tracer insert may include a lower edge, the lower edge is positioned proximate to the ledge.

In a fourth alternative embodiment according to the second alternative embodiment, the tracer insert may include a lower edge and a bevel opposite to the lower edge.

In a fifth alternative embodiment according to the fourth alternative embodiment, the bevel may extend away from the at least one edge wall inwardly toward the interior space.

In a sixth alternative embodiment according to the first alternative embodiment, the at least one chamber support includes ballast.

In a seventh alternative embodiment according to the first alternative embodiment, the at least one chamber support includes at least one post.

In an eighth alternative embodiment according to the seventh alternative embodiment, the at least one post includes ballast.

In an ninth alternative embodiment according to the seventh alternative embodiment, the shotgun shell tracer further includes ballast the ballast being constructed and arranged for positioning between the post and the at least one edge wall.

In a tenth alternative embodiment according to the ninth alternative embodiment, the ballast comprises at least one arcuate segment.

In an eleventh alternative embodiment according to the tenth alternative embodiment, the at least one arcuate segment forms a ring.

In a twelfth alternative embodiment according to the tenth alternative embodiment, the at least one arcuate segment is a washer.

In a thirteenth alternative embodiment according to the second alternative embodiment, the at least one edge wall comprises an exterior, the shotgun shell tracer further comprising at least one protective cup disposed about the exterior of the at least one edge wall.

In a fourteenth alternative embodiment according to the thirteenth alternative embodiment, the at least one protective cup is constructed and arranged to separate from the exterior of the at least one edge wall upon exit from a shotgun barrel following discharge of the shotgun shell tracer.

In a fifteenth alternative embodiment according to the second alternative embodiment, the at least one edge wall comprises an exterior, the shotgun shell tracer further comprising at least one protector disposed about the exterior of the at least one edge wall.

In a sixteenth alternative embodiment according to the fifteenth alternative embodiment, the at least one protector comprises film.

In a seventeenth alternative embodiment according to the sixteenth alternative embodiment, the at least one protector is constructed and arranged to separate from the exterior of the at least one edge wall upon exit from a shotgun barrel following discharge of the shotgun shell tracer.

In an eighteenth alternative embodiment a method of forming a shotgun shell tracer is disclosed comprising: molding at least one base wall, at least one obturator, at least one edge wall, the at least one edge wall defining an internal space in the tracer body; inserting the tracer body into a tubular carrier; transporting the tubular carrier having the tracer body to a loading device which is constructed and arranged to insert the tracer body into a shotgun shell casing and separating the tracer body from the tubular carrier; and releasably securing the tubular carrier to a conveyor device comprising a plurality of regularly spaced grasping or magnetic elements, each of the regularly spaced grasping or magnetic elements being constructed and arranged to engage the tubular carrier and to return the tubular carrier for insertion of another tracer body.

The above examples and disclosure are intended to be illustrative and not exhaustive. These examples and description will suggest many variations and alternatives to one of ordinary skill in this art. Further, the particular features presented in the dependent claims can be combined with each other in other manners within the scope of the invention such that the invention should be recognized as also specifically directed to other embodiments having any other possible combination of the features of the dependent claims.

This completes the description of the alternate embodiments of the invention. Those skilled in the art may recognize other equivalents to the specific embodiment described herein which equivalents are intended to be encompassed by the claims attached hereto.

I claim:

1. A shotgun shell tracer comprising:

at least one base wall, at least one obturator extending from said base wall, at least one edge wall extending from said at least one base wall opposite to said obturator, said at least one edge wall defining an internal space;

at least one chamber support engaged to said at least one base wall wherein said at least one chamber support extends from said at least one base wall within said internal space; and at least one tracer insert constructed and arranged to surround said at least one chamber support within said internal space, wherein said shotgun shell tracer has a first pre-discharge state and a second post-discharge state, said at least one tracer insert not being integral to said at least one base wall and said at least one chamber support in said first pre-discharge state, said at least one tracer insert being integral to said at least one base wall and said at least one chamber support in said second post-discharge state.

2. The shotgun shell tracer according to claim 1, wherein the at least one tracer insert is constructed and arranged such that discharge of a shotgun shell comprising said shotgun shell tracer exerts pressure which fuse said at least one tracer insert to said at least one base wall and said at least one chamber support, and embed said projectiles into said at least one tracer insert, establishing ballast for said shotgun shell tracer.

3. The shotgun shell tracer according to claim 2, said at least one chamber support comprising a ledge and said at least one tracer insert comprising a lower edge, said lower edge being positioned proximate to said ledge.

4. The shotgun shell tracer according to claim 2, said tracer insert comprising a lower edge and a bevel opposite to said lower edge.

5. The shotgun shell tracer according to claim 4, wherein said bevel extends away from said at least one edge wall inwardly toward said interior space.

6. The shotgun shell tracer according to claim 1, said at least one chamber support comprising ballast.

7. The shotgun shell tracer according to claim 1, said at least one chamber support comprising at least one post.

8. The shotgun shell tracer according to claim 7, said at least one post comprising ballast.

9. The shotgun shell tracer according to claim 7, further comprising ballast said ballast being constructed and arranged for positioning between said post and said at least one edge wall.

10. The shotgun shell tracer according to claim 9, said ballast comprising at least one arcuate segment.

11. The shotgun shell tracer according to claim 2, said at least one edge wall comprising an exterior, said shotgun shell tracer further comprising at least one protective cup disposed about said exterior of said at least one edge wall.

12. The shotgun shell tracer according to claim 11, said at least one protective cup being constructed and arranged to separate from said exterior of said at least one edge wall upon exit from a shotgun barrel following discharge of said shotgun shell tracer.

13. The shotgun shell tracer according to claim 2, said at least one edge wall comprising an exterior, said shotgun shell tracer further comprising at least one protector disposed about said exterior of said at least one edge wall.

14. The shotgun shell tracer according to claim 13, said at least one protector comprising film.

15. The shotgun shell tracer according to claim 14, said at least one protector being constructed and arranged to separate from said exterior of said at least one edge wall upon exit from a shotgun barrel following discharge of said shotgun shell tracer.

16. The shotgun shell tracer according to claim 1, said at least one chamber support comprising at least one divider section.

17. The shotgun shell tracer according to claim 1, said at least one edge wall comprising at least one slit.

18. The shotgun shell tracer according to claim 17, said at least one slit being constructed and arranged to form at least one petal.

19. The shotgun shell tracer according to claim 1, said at least one chamber support having a first height dimension and said at least one tracer insert having a second height dimension which is substantially equal to said first height dimension.

20. A shotgun shell tracer comprising:

a. at least one base wall, at least one obturator extending from said base wall, at least one edge wall extending from said at least one base wall opposite to said at least one obturator, said at least one edge wall defining an internal space;

b. at least one chamber support engaged to said at least one base wall wherein said at least one chamber support extends from said at least one base wall within said internal space, said at least one chamber support having a first height dimension; and c. at least one tracer insert constructed and arranged to surround said at least one chamber support within said internal space, said at least one tracer insert having a second height dimension which is substantially equal to said first height dimension, said at least one tracer insert not being integral to said at least one chamber support prior to discharge of a shotgun shell comprising said shotgun shell tracer wherein discharge of said shotgun shell comprising said shotgun shell tracer welds said at least one tracer insert to said at least one base wall and said at least one chamber support forming a unitary tracer component, wherein discharge of said shotgun shell embeds a plurality of projectiles into said tracer establishing ballast for said shotgun shell tracer.

* * * * *